US005555012A

United States Patent [19]

Ellson et al.

[11] Patent Number: 5,555,012

[45] Date of Patent: Sep. 10, 1996

[54] METHOD AND APPARATUS FOR IMPROVED USE OF THERMAL DONOR MEDIA

[75] Inventors: Richard N. Ellson; Lawrence A. Ray, both of Rochester, N.Y.

[73] Assignee: Eastman Kodak Company, Rochester, N.Y.

[21] Appl. No.: 251,871

[22] Filed: Jun. 1, 1994

[51] Int. Cl.[6] ..... B41J 35/32; B41J 35/00; B41J 17/00

[52] U.S. Cl. ..... 347/217; 347/215

[58] Field of Search ..... 347/217, 215, 347/171, 172

[56] References Cited

U.S. PATENT DOCUMENTS

| | | | |
|---|---|---|---|
| 4,577,198 | 3/1986 | Hibino ct al. | 347/215 |
| 4,668,961 | 5/1987 | Hiramatsu | 347/215 |
| 4,924,240 | 5/1990 | Herbert et al. | 347/217 |

FOREIGN PATENT DOCUMENTS

| | | | |
|---|---|---|---|
| 58-175676 | 10/1983 | Japan | 347/215 |
| 61-078684 | 4/1986 | Japan | 347/217 |
| 61-141582 | 6/1986 | Japan | 347/215 |
| 2-249680 | 10/1990 | Japan | 347/217 |
| 5-220993 | 8/1993 | Japan | 347/217 |

*Primary Examiner*—Huan H. Tran
*Attorney, Agent, or Firm*—Edward Dugas

[57] ABSTRACT

Method and associated apparatus for positioning a thermal donor media, having a plurality of transfer panels, each having a transfer area that is greater than the total area of a number of receiving media, such that a single transfer panel can provide an area of donor exclusively to each of the number of receiving media. The dimensions of unused areas of the thermal donor media are matched with the dimensions of the next to-be-printed image to enable a transfer printing to take place at an area that has dimensions that are equal to or greater than that required for the printed image. When an available area is identified the thermal donor media is moved into alignment and the transfer takes place. In one embodiment of the invention the thermal donor media is in the form of a ribbon that is wound between driven spools to bring unused areas into vertical printing alignment with the receiving media and the receiving media is displaced transverse to the ribbon to provide a horizontal alignment.

16 Claims, 6 Drawing Sheets

Fig. 7A
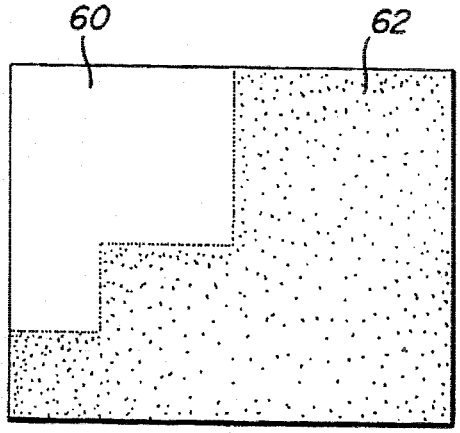
Fig. 7B
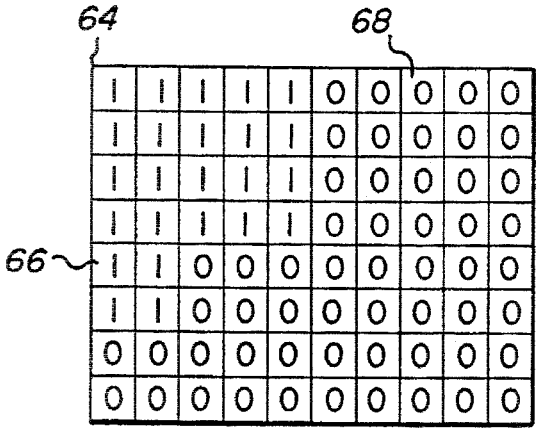
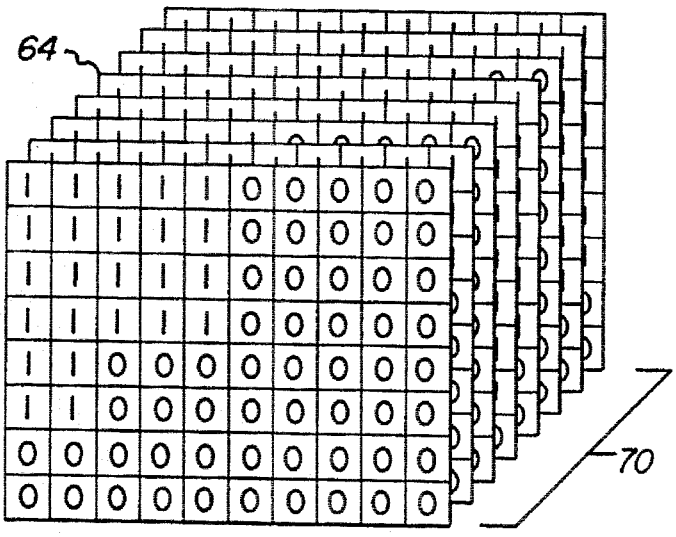
Fig. 8

METHOD AND APPARATUS FOR IMPROVED USE OF THERMAL DONOR MEDIA

FIELD OF INVENTION

The present invention relates to the field of color image printing with particular emphasis on the use of a controlling means and media positioning means to improve the efficiency of thermal donor media usage in a printing process.

BACKGROUND OF THE INVENTION

Thermal dye sublimation printing uses heat to transform colored dye on a donor ribbon into a gas which gets absorbed by a receiver media. This imaging process has the property that once a point of the thermal donor media has been used it cannot be reused, as insufficient amounts of dye remain for a second use. Thermal donor media comes in standard configurations such as a roll composed of a series of interleaved cyan, magenta, and yellow (CMY) panels. Not all of a given panel is consumed in a given print cycle. Some applications repeatedly print images of the same size and in the same location. The size is significantly smaller than the size of the CMY panels. Printers are produced which can print using any region of the CMY panels. Hence, a panel of thermal donor media is used a single time. If a repetitive printing application uses a well-defined region of the printable area and the image area is significantly smaller than a panel, there is a large amount of donor media which is not used and becomes waste. What is needed is a means for enabling less of each thermal donor media sheet to go unused.

The prior art teaches how to rewind thermal donor ribbon where the ribbon is multi-strike; that is, the same location of a ribbon can transfer dye repeatedly with minimal loss of quality. Some multi-strike ribbons achieve this through the use of a plurality of dye layers. U.S. Pat. No. 4,924,250 by Herbert, et al., and assigned to Alcatel Business Systems, Ltd., teaches how to rewind a multi-strike thermal donor ribbon containing a single dye. U.S. Pat. No. 4,496,955 by Maeyama, assigned to Sony, describes a process for a multi-strike thermal donor media composed of a repetitive sequence of CMY panels for color printing. The number of rewinds for a given CMY panel sequence, however, is predetermined.

Some thermal donor ribbon cannot be addressed multiple times as the initial transfer of dye alters the thermal donor transfer properties. If such a thermal donor ribbon were used, the printing would be defective and unreliable. In the case of such thermal donor ribbons, what is needed is a control means to position the donor ribbon and receiver media as to insure presentation of fresh regions of the rewound thermal donor to the thermal print head for transfer to the desired thermal receiver location.

SUMMARY OF THE INVENTION

The current invention describes a method and apparatus for specifying the image size, forming a pattern of media usage, and controlling the media positioning during printing. This allows for printing of more than one image per panel of thermal donor media if at least one image dimension is less than half of the corresponding thermal donor media dimension. This has the advantage of producing more images from a given roll of thermal donor media without requiring the thermal print head to address the same region of a given dye panel more than once. In addition, the present invention automatically determines the sequence and layout pattern of how the media will be used to print multiple images and instructs the media to be positioned properly with respect to the thermal write head to achieve this usage pattern.

A method embodiment of the invention for positioning a thermal donor media having a plurality of transfer panels each having a transfer area that is greater than the total area of a number of receiving media such that a single transfer panel can provide an area of donor exclusively to each of the number of receiving media, comprising the steps of:

determining the transfer area of a transfer panel of the thermal donor media;

determining the area of each of the number of receiving media;

identifying an individual portion of the transfer area of the thermal donor media with each of the receiving media; and positioning each transfer area with its identified receiving media and performing a donor transfer.

From the foregoing it can be seen that it is a primary object of the present invention to use more of the thermal donor media than has been used in the past when printing images that leave a large area of the thermal donor media in a panel unused.

It is another object of the present invention to provide a technique for determining the dimensions of unused portions of a previously used thermal donor media for the purpose of matching the dimensions with yet-to-be printed images.

Yet another object of the present invention is to provide an apparatus that will correctly register an unused area of a thermal donor media with a to-be-printed receiver media.

The above and other objects of the present invention will become more apparent when taken in conjunction with the following description and drawings wherein like characters indicate like parts and which drawings form a part of the present invention.

Advantageous Effect of the Invention

This invention reduces the amount of unused thermal donor media used in the production of printed material where the print area is significantly less than the size of the thermal donor media area. This reduces the cost of printing as well as reducing the amount of waste produced by the thermal printing process. This method does not require a complete rewind of the entire thermal donor media spool as in the prior art. This method also allows for a dynamic layout of images to optimize consumption of thermal donor media.

BRIEF DESCRIPTION OF THE DRAWINGS

FIG. 7A illustrates the used and unused areas of a panel of thermal donor media.

FIG. 7B illustrates a memory bit map corresponding to the used and unused areas of the thermal donor media of FIG. 7A.

FIG. 8 illustrates, in perspective view, memory bit maps representing a plurality of panels of thermal donor material.

DETAILED DESCRIPTION OF THE INVENTION

Figure 1:
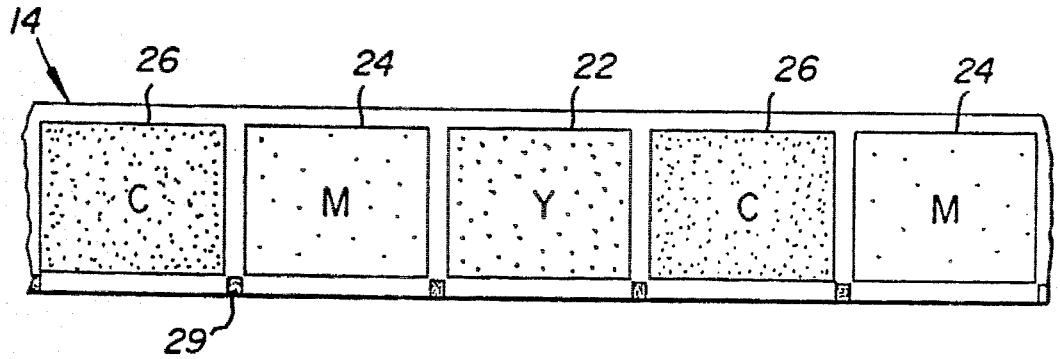
FIG. 1 illustrates one segment of a ribbon of thermal donor media containing a number of panels of transfer dye.

Referring to FIG. 1, the thermal donor media 14 is shown in the form of a web with a repeating sequence of sections or panels of thermally transferable dye. Each panel in a sequence has a different color heat transferable dye. For example, each sequence of panels includes a panel of yellow thermally transferable dye 22, followed by a panel of magenta thermally transferable dye 24, followed by a panel of cyan thermally transferable dye 26. This sequence of yellow, magenta and cyan dye panels is repeated along the web. Reference marks 29 are used in a well-known manner to control the operation of the winding and rewind devices 12 and 13 shown in FIG. 2 in properly placing the panels in a print or transfer position.

Figure 2:
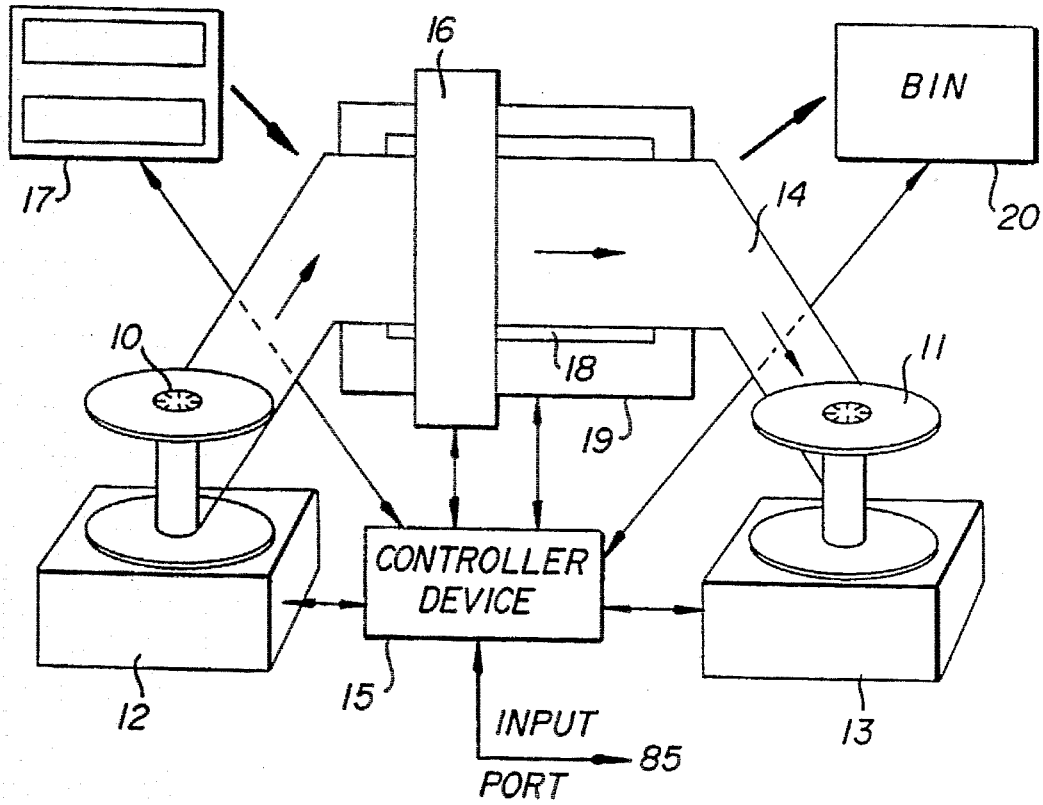
FIG. 2 illustrates the preferred apparatus embodiment of the invention for processing rolled thermal media.

Referring to FIG. 2, thermal printing is performed by first positioning the thermal donor media 14 between a thermal head device 16 and a receiver media 18. Next image information is sent to a controller device 15 that modulates the heat generated by the thermal head device 16 in order to cause a transfer of dye from the thermal donor media 14 to the receiver media 18. In many applications the receiver media 18 is passed under the thermal donor media 14 three times as a panel of cyan (C), magenta (M) and yellow (Y) donor media is introduced. For an example of such an arrangement see U.S. Pat. No. 4,745,413. The thermal donor media 14 is generally manufactured onto a spool 10 with alternating CMY color panels (shown in FIG. 1). As the thermal donor media 14 is used, it is taken up by a spool 11. The take-up spool 11 is driven by a winding device 13 which is controlled by the controller device 15. The spool 10 containing the unused thermal donor media is driven by a rewind device 12 which is also controlled by the controller device 15 to controllably rewind the thermal donor media 14 back onto the spool 10. An input port 85, which may be a bidirectional data bus, is provided to receive input data, such as image data from a remote location. A source of receiver media 17 such as dual paper trays and associated circuitry for activating the trays is controlled by the controller device 15 to provide receiver media 18 when needed. A bin 20 receives the printed on receiver media 18 and is controlled by the controller device 15 for removal of paper jams.

For those applications where an image is to be printed at the same place on the receiver media 18, and the area taken up by the image is smaller than the size of the thermal donor media 14, it is possible to print one or more additional images using the previously unused areas of the thermal donor media 14. One such application occurs in the printing of images on transaction (credit) cards, where the printed area is a small region within the card. Each card will have the image in the exact same location, and the image size is much smaller than the area of the thermal donor media 14. As a result, much of the thermal donor media 14 goes unused. This is the method used by the Datacard 9000 transaction card production device.

For illustrative purposes, if the size of a single color panel (dye sheet) is 4 inches by 3 inches and the print area is under one square inch, the same material could be used 12 times as long as no area was used twice. This would require that the receiver media 18 be translated in position relative to the thermal donor media 14. This is accomplished either by translating the position of the thermal donor media 14, much like modifying the position of the ribbon of a multicolor typewriter ribbon, or by translating the position of the receiver media 18. The preferred method is to change the location of the receiver media 18 and to allow the thermal donor media 14 to remain fixed.

Figure 3A:
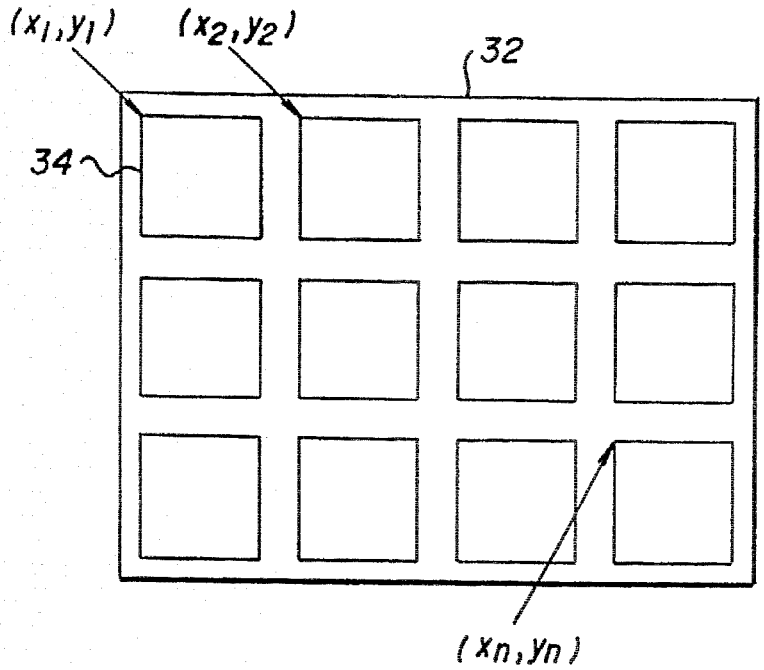
FIG. 3A illustrates the starting positions for a plurality of images to be printed from a single transfer panel of thermal donor media.
Figure 3B:
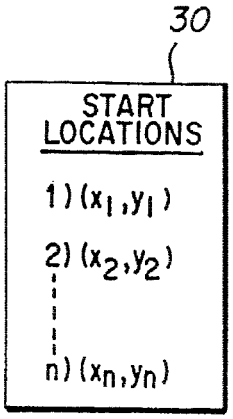
FIG. 3B illustrates a table containing the starting positions for the images of FIG. 3A in x,y coordinate form.

Referring back to FIG. 2, the control of the print position is accomplished by means of the controller device 15, the rewind device 12, and a thermal media receiver translator 19. FIGS. 3A and 3B illustrate an operational strategy for operating the thermal donor media 14 rewind in an application where the thermal donor media 14 sheets are significantly larger than the desired printed image size and where a multiplicity of like-sized images, generally denoted 34, are to be printed on the receiver media 32. A set of offset edge positions for each pass of the thermal donor media is determined as a list of X and Y values 30. The list can also be arranged as a TDMU map 64, described further below.

Figure 4:
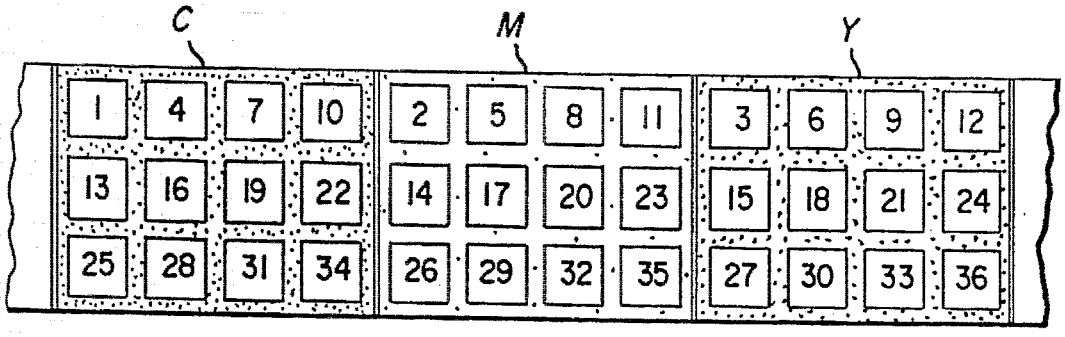
FIG. 4 illustrates the strip of thermal donor media of FIG. 1 with a plurality of color component images allocated to respective panels of transfer dye.

FIG. 4 illustrates offset image positions on the three panels labeled C, M and Y, each numbered in the order they are addressed by the thermal print head for the start locations 30 of FIG. 3B. The numbered images range from 1 to 36, and for a three-color process are arranged in triplets, one from each panel. For example, the triplets 1,2,3 form the C,M,Y layers, respectively, together will form the first image printed by the thermal print head. The second image C,M,Y layers are printed from offset image positions denoted by triplet 4,5,6. The print sequence continues in this manner until the printing of the twelfth image whose C,M,Y layers correspond to offset image positions 34, 35, and 36. At this point, the thermal donor media roll is advanced to the beginning of the next set of CMY panels.

Figure 5:
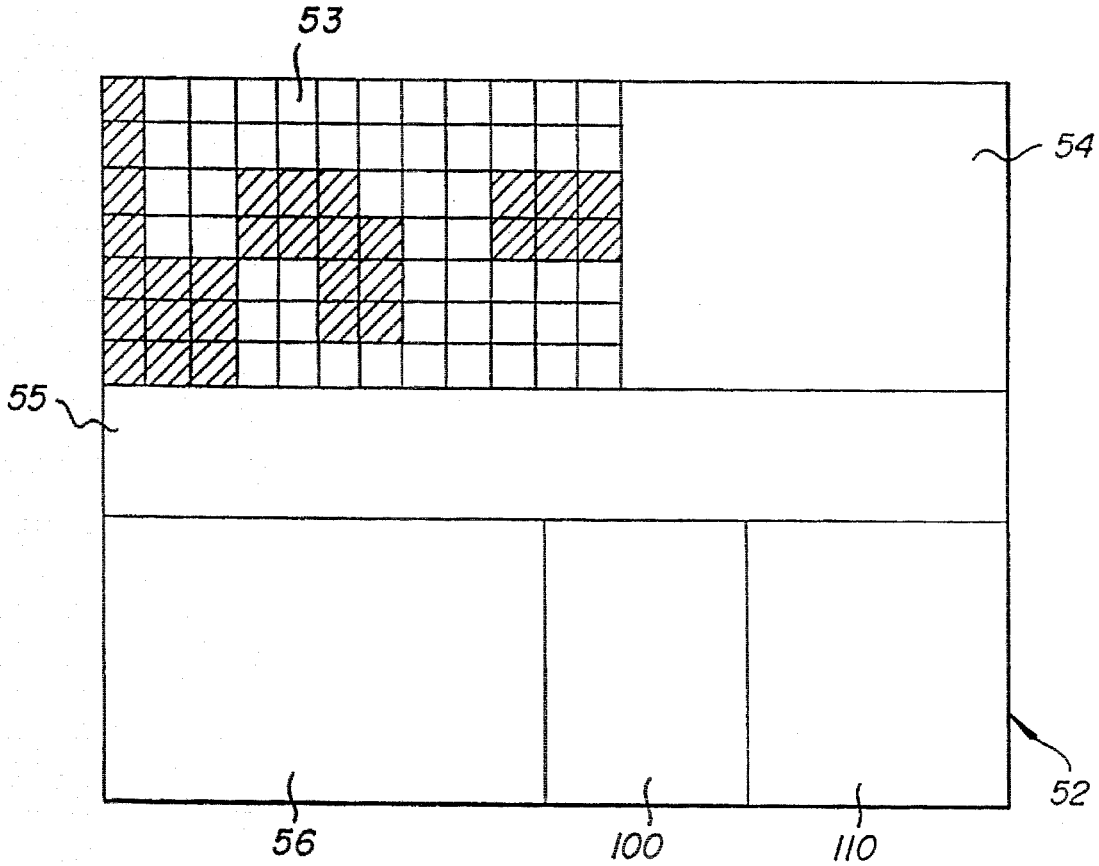
FIG. 5 illustrates an example arrangement of a thermal donor utilization map within a microprocessor.

Referring to FIG. 5, which is a block description of a controller device memory 52. The controller device memory 52 is segmented into a number of regions, a thermal donor media utilization memory 53, a region that maintains the last noted status of the printer subsystems 54, a region for image data memory 56, a region for storing other processor task data 55, a thermal donor media status memory 100,and a thermal donor panel utilization memory 110.

Figure 6:
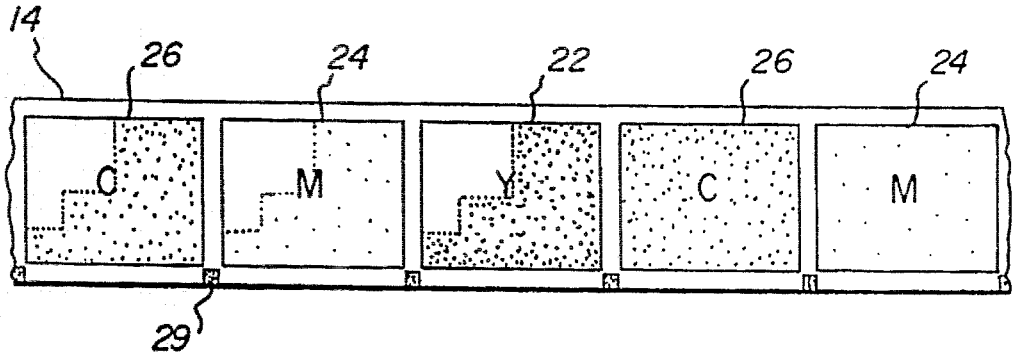
FIG. 6 illustrates the strip of thermal donor media of FIG. 1 with partially used areas appearing light and unused areas appearing dark.

FIG. 6 illustrates the usage patterns for three of the color panels in a web of thermal donor media 14. The light portions indicated the exhaustion of the dye from the panels. The dark portions indicate the presence of the dye.

FIG. 7A is a representation of one of the panels with the light and dark areas numbered 60 and 62, respectively. FIG. 7B corresponds to a TDMU map 64 that is stored within the thermal donor media utilization memory 53. As shown, the light and dark areas and 62 of FIG. 7A are mapped to 1's in map cells 66 and to 0's in map cells 68. The controller device 15 maintains the thermal donor media utilization map or TDMU map 64, of the previously used regions of thermal donor media 14. The controller device 15 uses the TDMU map 64 to determine if the current thermal donor media 14 have sufficient unused area for the printing of the requested printing task, and moving the thermal media receiver translator 19 in order that the requested printing process will use fresh thermal donor media 14. Once the requested image size is known the controller device 15 converts this information into terms of the number of required cells and searches through the map looking for previously unused portions of thermal donor media 14. Once the image has been printed then the controller device 15 updates the map by changing the cells corresponding to the used thermal donor media 14 to the "used" state. If no such area is found the controller device 15 signals the winding device 13 to introduce fresh panels of thermal donor media 14 and resets all the cells in the aforementioned map to the "unused" state.

At some point in the printing process the controller device updates the TDMU map 64 contained in the controller device memory 52. It is preferrable that the TDMU map update occur just prior to the physical printing in case some malfunction occurs during the printing process. Those cells of the TDMU map 64 that are associated with the area of the thermal donor media 14 used for the printing are changed from the unused to the used state. The association of those cells is determined by the particular application and embodiment of the invention. In some instances, such as when the same size image is always to be printed, e.g., on transaction cards, the cell size is the same as image size and for each image printed a single cell of the TDMU is altered. In other embodiments the cell size may refer to an area the size of a single printed pixel and in that case a plurality of cell states will be altered for a printed image.

In one embodiment of this invention the offset positions are used by the controller device 15 to cause the combination of winding device 13 and rewind device 12 to advance the thermal donor media to the offset indicated by the first component of the offset position, for example, $X_1$, in FIG. 3B. The second offset position is used by the controller device 15 to direct the thermal media receiver translator 19. These positions are such that the image 34, to be printed from the thermal donor media will be formed using a previously unused portion of the thermal donor media.

After the printing associated with each list is completed, the controller device 15 directs the winding device 13 to advance the thermal donor media to a new set of thermal donor media panels in order for the process to repeat.

It should be understood that the list of start locations 30 may not all be pointing to images with the same dimensions. It is only necessary to have the dimensions of a to-be-printed image correspond to the dimensions of an unprinted thermal donor media 14. Additionally, the present invention does not require that future sequences of image dimensions be known to the controller, nor is it required to follow the sequence discussed in FIG. 3B.

The controller device 15 maintains a map, hereinafter referred to as the thermal donor media utilization map or TDMU map 64, of the previously used regions of thermal donor media 14. As previously stated, the aforementioned TDMU map 64 is a two-dimensional array where each element in the array refers to a portion of the thermal donor media 14. This is analogous to the use of pixels to describe an image. However, in this case the elements only need to maintain whether the cell has been used, i.e., one bit of information for each element either "used" or "unused." The individual cells can be referenced in a standard manner by an ordered pair of indexes, e.g., (i,j). FIG. 3A shows one embodiment of the TDMU map 64 when the application assumes that the printed images are to be of the same size and the printed image size is sufficiently small so that a multiplicity of images can be printed from the same portion of thermal donor media 14. Other applications may use the TDMU map 64 where the size of the cells are smaller, e.g., less than the size of a complete image. The controller device 15 uses the TDMU map 64 to determine if the current thermal donor media 14 have sufficient unused area for the printing of the requested printing task, and moving the thermal media receiver translator 19 in order that the requested printing process will use fresh thermal donor media 14. Once the requested image size is known the controller device 15 converts this information into terms of the number of required cells and searches through the map looking for previously unused portions of thermal donor media 14. Once the image has been printed then the controller device 15 updates the map by changing the cells corresponding to the used thermal donor media 14 to the "used" state. If no such area is found the controller device 15 the winding device 13 to introduce fresh panels of thermal donor media 14 and resets all the cells in the aforementioned map to the "unused" state.

The controller device 15 needs to be aware of the size of the receiver media 18, the size of the intended image, and the offset of some image position, e.g., upper left hand corner. With this information and the information contained in the TDMU map 64 the controller device 15 can effectively determine appropriate translation coordinates for the thermal media receiver translator 19. Given that a TDMU map cell refering to a portion of the thermal donor media of dimensions ($c_h$, $c_v$) in some standard unit of linear measure, e.g. inches, and an intended image being of a size $I_h \times I_v$, with the position of the image on the thermal receiver to be at ($T_h$, $T_v$), letting $P_h$ be the smallest integer larger than $I_h/c_h$, and $P_v$ be the smallest integer larger than $I_v/c_v$, then the controller device 15 can use the TDMU map 64 to determine an ordered pair ($i_L$,$j_L$) where this pair has the property that all cells of the TDMU map and bounded by ($i_L$, $j_L$), ($i_L+P_h$, $j_L$), ($i_L$,$j_L+P_v$), and ($i_L+P_h$, $j_L+P_v$) in the unused state. Then horizontal and vertical translation distances sent from the controller device 15 to the thermal media receiver translator 19 are given by:

$$i_L * c_h + T_h, \text{ and } jL * c_v + T_v,$$

respectively.

Referring more specifically to the controller device 15, it has several functions, including, directing the winding device 13, directing the rewind device 12, controlling the thermal media receiver translator 19, and activating the thermal head device 16 to produce a heat pattern that is a function of the to-be-printed image. The winding device 13, rewind device 12, and the thermal media receiver translator 19 have to work in concert in order to be sure that the receiver media 18 is printed using an unused section of the thermal donor media 14.

Each sub-device (e.g., thermal media receiver translator 19) maintains a set of status flags appropriate to that device which can be polled by the controller device 15 in order for the controller to determine at any time the status of the overall print station. An example of such a status indicator will be an indicator in the winding device 13 that indicates the presence of thermal donor media 14. If the thermal donor media 14 is not present the indicator will be set at a negative state and, when polled by the controller device 15, the negative state will be sensed. The controller device 15 will in turn not proceed with a printing until the indicator is set to the positive state by the act of loading the thermal donor media 14 onto the winding device 13.

Included as part of the controller device memory is a section denoted as the thermal donor media status memory 100. As shown in FIGS. 9A through 9D, there are various methods that this memory can be used to monitor the usage of the thermal donor panels. This monitoring process differs from the notion of the TDMU map, though the two are linked, in that TDMU map monitors the utilization of a single set of CMY panels, whereas this monitoring keeps track at a higher management level of a plurality of panels through a stack of TDMU maps 70 as shown in FIG. 8.

Figure 9A:
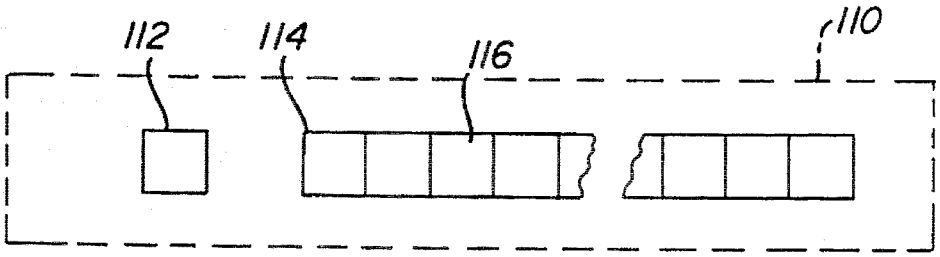
FIGS. 9A through 9D illustrate a number of bit stream variations for indicating the availibility of areas of thermal donor material.

FIG. 9A is one such method, which is comprised of a Thermal Donor Panel Utilization Memory 110 in the form of a list, where the first entry in the list 112 is a number which indexes the first panel of unused thermal donor media 14. Following this initial number is the list of partially used thermal donor panels 114. An individual entry 116 in the list is a number which indicates the panel is partially used. These panels are linked to a sequence of TDMU maps with the controller device memory 52. The linkage is direct in that the the first list on the map is the first TDMU map in memory.

Figure 9B:
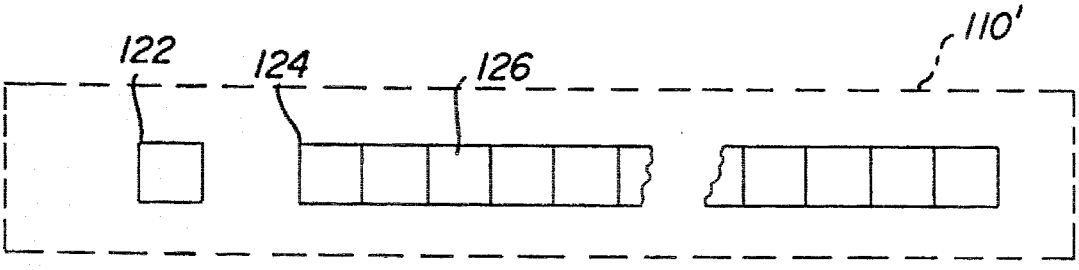

FIG. 9B describes a method similar to the method shown in FIG. 9A. The entry 122 is an index to the first unused panel, and plays the same role a 112. The following entries 124 are simple one-bit flags indicating whether the panel has been exhausted. In particular the element of the list 126 is set to an "exhausted"on state or to an "available space" state. The order to the TDMU maps in the controller device 15 memory are sequenced the same as the position of the "available space" states, e.g., the third panel with a "space available" state is the third TDMU map.

Figure 9C:
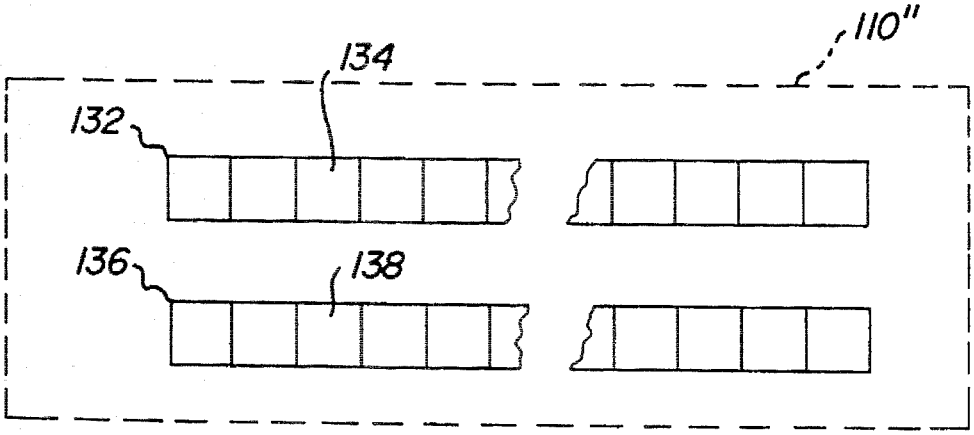

FIG. 9C refers to yet another method, where there is a dual list. The first list 132 is a map of exhausted panels. The entries 134 are binary flags indicating whether a panel has been exhaust or not. The second list 136 is a map of panels that have had donor used. An entry 138 indicates whether the associated panel has been used or not. The combination of these two lists will retrieve the same information as the methods described in FIGS. 9A and 9B.

Figure 9D:
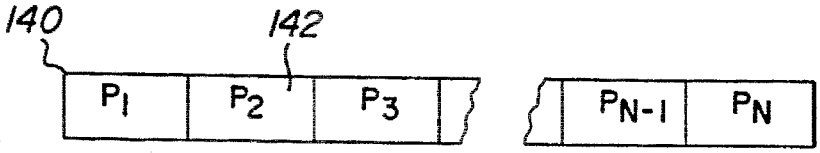

FIG. 9D refers to a more flexible means of accessing the TDMU map stack. The previous methods all assume that the TDMU map stack is in the same order as the list. However, as the thermal donor media 14 is being used the order that the panels become exhausted is somewhat random. The previous method requires that the TDMU map stack be updated by data copies to retain its integrity. However, the same functionality can be achieved by a list of pointers 140 to the starting memory location 142 for the TDMU map for the active panel of interest.

Figure 10:
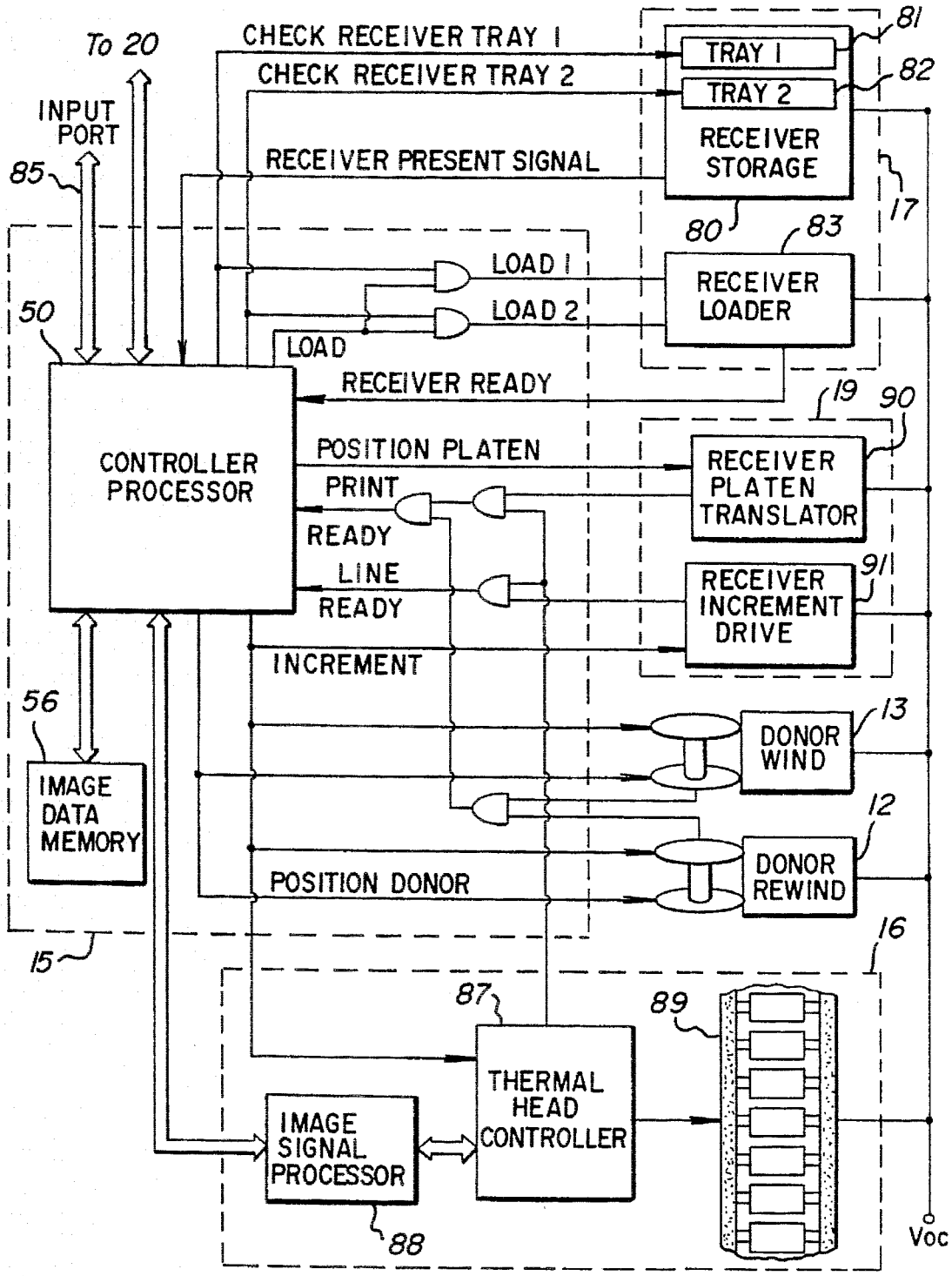
FIG. 10 illustrates in block diagram form the preferred apparatus embodiment of the present invention.

The controller device 15 constantly monitors the status indicators of all sub-devices by polling and determines the action of the printing device by the responses received from the polling and the point in the printing sequence that is expected to occur. FIG. 10 describes the control circuit used by the controller device 15 for this process. The controller device 15 maintains the status of the printing device and determines the sequence and timing of all events. When a new image is to be printed, the controller signals that a piece of receiver media 18 to be inserted into a thermal media receiver platen translator device 90. The controller device 15 signals the receiver storage device 80 as to which receiver media tray to use, either 81 or 82. In those embodiments with only a single tray, the aforementioned step is irrelevant and can be ignored. The receiver storage device sets "receiver present signal" positive if there is the proper media present in the unit. The controller device 15 then signals the receiver loader device 83 to take a piece of receiver media from the storage unit and to load the receiver media onto the printer platen. Upon successful completion of this task the receiver loader device 83 sets the "receiver ready" status to positive. While receiver media 18 is being inserted, the controller device 15 determines the required thermal donor media translation units from the TDMU map 64 and image descriptor information that comes with the image through the input port 85. The control device 15 then transmits to the thermal media receiver translator 19 the translation values. Once the thermal media receiver translator 19 completes the requested translation, it then sets its status to "succesful translation." The controller device also directs both the thermal rewind device 12 and the winding device 13 to position the thermal donor media 14 to either a fresh panel of thermal donor media or to rewind the thermal donor media to a partially used panel. Once this is complete the winding device 13 and the rewind device 12 signal that the "position donor" as successful. The winding device and the rewinding device will also sense whether thermal donor media is present and will not signal that the "position donor" as successful until the the presence of donor is sensed. The control device also indicates to the thermal head controller 87 to prepare for a printing task and to warm the thermal head 89 to the proper operating temperature. Once this status has been attained the thermal head controller 87 returns a "print ready" status.

Other sub-devices shown in FIG. 10 are common to thermal printers and are not part of the present invention and are included for completeness. Items such as the receiver increment drive 91, the image signal processor 88, image data memory 56 all fall into this category. However, these components are essential for the proper operation of the thermal printing device.

After the thermal head device 16 has completed printing an image and either the thermal donor media has been rewinded or advanced to a fresh portion of the thermal donor media, the thermal head device has to be repositioned to an initial starting location in order to minimize and control the effects of thermal head devices in proximity to unused thermal donor media. This is necessitated because the residual head of the thermal head will cause the thermal donor media 14 to degrade.

Another embodiment of the present invention contemplates the printer accepting a plurality of thermal donor media 14 sizes. In this case the controller device 15 has the additional task of polling the winding device 13 and/or the rewind device 12 to determine the size of thermal media donor 14 currently loaded into the printer. Alternatively, a user can select the thermal donor media 14 size. In either case the controller device 15 has to include the size of the thermal donor media 14 as part of the method for locating previously unused portions of the thermal donor media 14.

The controller device 15 maintains the status of the printing device and determines the sequence and timing of all events. When a new image is to be printed, the controller signals that a piece of receiver media 18 is to be inserted into the thermal media receiver translator 19.. The controller device 15 awaits a signal back from the thermal media receiver translator 19 indicating that the receiver media 18 has been successfully inserted into the thermal media receiver translator 19. While receiver media 18 is being inserted, the controller device 15 is directing both the rewind device 12 and the winding device 13 to position the thermal donor media 14.

Upon system start-up the controller device 15 will check a number of items, such as whether receiver media 18 is available, whether thermal donor media 14 is present, and whether the thermal head device 16 is properly positioned to commence printing. If the controller device 15 is signaled that the thermal donor media 14 is loaded then controller device 15 signals the winding device to wind the spool until a fresh CMY panel of thermal donor media is ready to be used. The controller device 15 sets its status of thermal donor media 14 to the first image to be printed and polls the winding device 13 and rewind device 12 until a status that the image data has been loaded into the printing system is set to be positive. Once that signal is received, the controller device 15 sends a signal to the thermal receiver supply to insert a new receiver media 18 into the thermal media receiver translator 19 and returns a signal that the process has been completed. The controller device 15 then signals the thermal media receiver translator 19 to position the receiver media 18, either by relative or by absolute coordinate locations, with the preferred coordinates being the absolute coordinates. The controller device 15 awaits for a signal that the translation has been successfully completed. Once the successful translation signal has been received the controller device 15 then activates the thermal head device 16 to print the image onto the receiver media 18 in the usual fashion. The controller device 15 waits until the thermal printing device status indicates the image has been successfully printed. Upon receipt of this signal, the controller device 15 signals for the ejection of the receiver media 18 from the thermal media receiver translator 19. While this is occurring the controller device 15 checks the status device to determine whether the last image printed completed the sequence of images printed from the CMY panel. If the CMY panel is fully used, then the controller device 15 signals the winding device 13 to wind the spool until a fresh CMY panel is ready to be used. If the CMY panel is not fully used, then the rewind device 12 is signaled to rewind the thermal donor media 14 to the position where the spools were located prior to the just completed image printing. The controller device 15 then updates the image status by incrementing an image counter and by moving a pointer to the next set of coordinates to be sent to the thermal media receiver translator 19.

After the thermal head device 16 has completed printing an image and either the thermal donor media 14 has been rewound or advanced to a fresh portion of the thermal donor media 14, the thermal head device 16 has to be repositioned to an initial starting location in order to minimize and control the effects of the thermal head device 16 being in proximity to any unused thermal donor media 14. This is necessitated because the residual heat in the thermal head device 16 will cause the thermal donor media 14 to degrade.

Another arrangement of the present invention is to arrange for the printer to accept a plurality of sizes of thermal donor media 14. In this arrangement the controller has the additional task of polling the winding device 13 and/or the rewind device 12 to determine the size of thermal donor media 14 currently loaded into the printer. Alternatively, a user can select the thermal donor media 14 size. In either case the controller device 15 has to include the size of the thermal donor media 14 as part of the method for locating previously unused portions of the thermal donor media 14.

An embodiment of the present invention permits an efficient use of thermal donor media though the size of the image to be printed is unknown prior to being requested to print. In this case the size of the region of the thermal donor media 14 associated with a cell in the TDMU map 64 directly relates to how finely the controller device 15 can direct the thermal media receiver translator 19 to portions of unused thermal donor media 14. In this case the area represented by a TDMU map cell is sufficiently small in order for the controller device 15 to use the thermal donor media 14 efficiently. If no such area is found the controller signals the winding device 13 to introduce fresh panels if thermal donor media 14 and resets all the cells in the aforementioned map to the "unused" state.

Still another embodiment is where the controller device 15 is aware of several pending image requests and determines the use of thermal donor media 14 in an efficient manner. This requires the controller device 15 to maintain a TDMU map 64 as previously mentioned, but additionally the controller device 15 determines location and printing order in an efficient manner. This notion is similar to the process a seamstress uses to use fabric in an efficient manner. The order of the printing may change in the case where a print request which uses a large portion of thermal donor media 14 would require fresh CMY panels, but a later print request could be fit on the current and partially used thermal donor media 14. The controller device 15 would determine the new order and rearrange the printing queue to be in the more efficient order.

In yet another embodiment of the invention a plurality of receiver media 18 sizes may be processed. In this embodiment the controller device 15 polls the thermal donor supply in order to ascertain the size of the receiver media 18. Once the controller device 15 has this information it needs it readjusts the travel limits of the thermal media receiver translator 19 to accommodate the sensed size of the media.

In the case of images of varying sizes, the controller has the additional purpose of determining the size of the image and the area of the thermal donor media 14 that is unused to assign an approximate region of the thermal donor media 14 to be used for the printing of the image. If no such area exists on a previously used CMY panel, then the controller device 15 directs the winding device to move to a fresh piece of thermal donor media 14.

While there has been shown what are considered to be the preferred embodiments of the invention, it will be manifest that many changes and modifications may be made therein without departing from the essential spirit of the invention. It is intended, therefore, in the annexed claims, to cover all such changes and modifications as may fall within the true scope of the invention.

Parts List

10 Spool
11 Spool
12 Rewind device
13 Winding device
14 Thermal donor media
15 Controller device
16 Thermal head device
17 Receiver media storage tray(s)
18 Receiver media
19 Thermal media receiver translator
20 Bin for receiver media
22 Thermally transferable dye
24 Thermally transferable dye
26 Thermally transferable dye
29 Reference marks
30 Start locations
32 Receiver media
34 Image

52 Controller device memory
53 Thermal donor media utilization memory
54 Printer subsystems
55 Processor task data
56 Image data memory
60 Light and dark areas
62 Light and dark areas
64 TDMU map
66 map cells
68 map cells
70 TDMU maps
80 Receiver storage device
81 Receiver media storage tray 1
82 Receiver media storage tray 2
83 Receiver loader device
85 input port
87 Thermal head controller
88 Image Signal Processor
89 Thermal head
90 Thermal media receiver platen translator device
91 Receiver Increment Drive
100 Thermal donor media status memory
110 Thermal donor panel utilization memory
112 List
114 Thermal donor panels
116 Individual entry
122 Entry
124 Entries
126 List
132 List
134 ntries
136 List
138 Entry
140 Pointers
142 starting memory location

We claim:

1. A method for positioning a thermal donor media having a plurality of transfer panels each having a transfer area that is greater than the total area of a number of receiving media such that a single transfer panel can provide an area of donor exclusively to each of the number of receiving media, comprising the steps of:

determining the transfer area of a transfer panel of the thermal donor media;

determining the area of each of the number of receiving media;

identifying an individual portion of the transfer area of the thermal donor media with each of the receiving media; and positioning each transfer area with its identified receiving media and performing a donor transfer.

2. A method for positioning a thermal donor media having a plurality of transfer panels each having a transfer area that is at least twice the area of a receiving media such that a single transfer panel can provide an area of donor exclusively to a number of receiving media, comprising the steps of:

determining the transfer area of a transfer panel of the thermal donor media;

determining the area of the receiving media;

determining the number of receiving media that can be assigned to individual portions of the transfer area of the donor media;

assigning the number of determined individual portions of the transfer area with the number of receiving media; and positioning each individual portion of the transfer area with its assigned receiving media and performing a donor transfer.

3. A method for positioning a thermal donor media having a plurality of transfer panels each having a transfer area that is at least twice the area of the smallest receiving media such that a single transfer panel can provide an area of donor exclusively to at least two receiving media, comprising the steps of:

determining the transfer area of a transfer panel of the thermal donor media;

determining the area of each receiving media;

determining the number of receiving media that can be assigned to individual portions of the transfer area of the donor media;

assigning the number of determined individual portions of the transfer area with the number of receiving media; and positioning each individual portion of the transfer area with its assigned receiving media and performing a donor transfer.

4. A method for positioning a thermal donor media having a plurality of groups of transfer panels each having a transfer area that is greater than the total area of a number of receiving media such that a single transfer panel can provide an area of donor exclusively to each of the number of receiving media and wherein the transfer panels within a group each contain a dye for forming one component of a color transfer, comprising the steps of:

determining the transfer area of a transfer panel of the thermal donor media;

determining the area of each of the number of receiving media;

identifying an individual portion of the transfer area of the donor media with each of the receiving media; and sequentially positioning each transfer area within each group with its identified receiving media and performing a donor transfer so as to form a color image on the receiving media.

5. A method for positioning a rolled ribbon of thermal donor media having a plurality of groups of transfer panels each having a transfer area that is greater than the total area of a number of receiving media such that a single transfer panel can provide an area of donor exclusively to each of the number of receiving media and wherein the transfer panels within a group each contain a dye for forming one component of a color transfer, comprising the steps of:

determining the dimensions within a transfer panel of unused thermal donor media;

determining the dimensions of a next to be printed receiving media;

identifying an individual unused portion of the thermal donor media with the next to be printed receiving media; and positioning the identified individual unused portion of the thermal donor media with the receiving media and performing a donor transfer so as to form a color image on the receiving media.

6. The method according to claim 5 and further comprising the steps of:

locating one or more previously used transfer areas on the roll of transfer media with an unused dimension that is equal to or greater than the dimensions of the next to be printed receiving medium for performing a donor transfer.

7. The method according to claim 6 and further comprising the step of:

storing data corresponding to the dimensions of unused portions of the transfer panels so as to facilitate the location of unused transfer areas on the roll of transfer media.

8. A method for positioning a thermal donor media having a plurality of transfer panels each having a transfer area that is at least twice the dimensions of an image that is to be transferred to a receiving media such that a single transfer panel can provide an area of donor exclusively to a number of receiving media, comprising the steps of:

determining the dimensions of the to be transferred image;

determining the number of images that can be transferred from the transfer area of the transfer panel of the thermal donor media;

identifying an individual portion of the transfer panel of the donor media with each image; and positioning each individual portion of the transfer panel with respect to a receiving media to effect a donor transfer of the image to the receiving media.

9. Apparatus for positioning a thermal donor media having a plurality of transfer panels each having a transfer area that is greater than the total area of a number of receiving media such that a single transfer panel can provide an area of donor exclusively to each of the number of receiving media, comprising:

means for determining the transfer area of a transfer panel of the thermal donor media;

means for determining the area of each of the number of receiving media;

means for identifying an individual portion of the transfer area of the thermal donor media with each of the receiving media; and means for positioning each transfer area with its identified receiving media and performing a donor transfer.

10. Apparatus for positioning a thermal donor media having a plurality of transfer panels each having a transfer area that is at least twice the area of a receiving media such that a single transfer panel can provide an area of donor exclusively to a number of receiving media, comprising:

means for determining the transfer area of a transfer panel of the thermal donor media;

determining the area of the receiving media;

means for determining the number of receiving media that can be assigned to individual portions of the transfer area of the donor media;

means for assigning the number of determined individual portions of the transfer area with the number of receiving media; and means for positioning each individual portion of the transfer area with its assigned receiving media and performing a donor transfer.

11. Apparatus for positioning a thermal donor media having a plurality of transfer panels each having a transfer area that is at least twice the area of the smallest receiving media such that a single transfer panel can provide an area of donor exclusively to at least two receiving media, comprising:

means for determining the transfer area of a transfer panel of the thermal donor media;

means for determining the area of each receiving media;

means for determining the number of receiving media that can be assigned to individual portions of the transfer area of the donor media;

means for assigning the number of determined individual portions of the transfer area with the number of receiving media; and means for positioning each individual portion of the transfer area with its assigned receiving media and performing a donor transfer.

12. Apparatus for positioning a thermal donor media having a plurality of groups of transfer panels each having a transfer area that is greater than the total area of a number of receiving media such that a single transfer panel can provide an area of donor exclusively to each of the number of receiving media and wherein the transfer panels within a group each contain a dye for forming one component of a color transfer, comprising:

means for determining the transfer area of a transfer panel of the thermal donor media;

means for determining the area of each of the number of receiving media;

means for identifying an individual portion of the transfer area of the donor media with each of the receiving media; and means for sequentially positioning each transfer area within each group with its identified receiving media and performing a donor transfer so as to form a color image on the receiving media.

13. Apparatus for positioning a rolled ribbon of thermal donor media having a plurality of groups of transfer panels each having a transfer area that is greater than the total area of a number of receiving media such that a single transfer panel can provide an area of donor exclusively to each of the number of receiving media and wherein the transfer panels within a group each contain a dye for forming one component of a color transfer, comprising:

means for determining the dimensions within a transfer panel of unused thermal donor media;

means for determining the dimensions of a next to be printed receiving media;

means for identifying an individual unused portion of the thermal donor media with the next to be printed receiving media; and means for positioning the identified individual unused portion of the thermal donor media with the receiving media and performing a donor transfer so as to form a color image on the receiving media.

14. The apparatus according to claim 13 and further comprising:

means for locating one or more previously used transfer areas on the roll of transfer media with an unused dimension that is equal to or greater than the dimensions of the next to be printed receiving medium for performing a donor transfer.

15. The apparatus according to claim 14 and further comprising:

means for storing data corresponding to the dimensions of unused portions of the transfer panels so as to facilitate the location of unused transfer areas on the roll of transfer media.

16. Apparatus for positioning a thermal donor media having a plurality of transfer panels each having a transfer area that is at least twice the dimensions of an image that is to be transferred to a receiving media such that a single transfer panel can provide an area of donor exclusively to a number of receiving media, comprising:

means for determining the dimensions of the to be transferred image;

means for determining the number of images that can be transferred from the transfer area of the transfer panel of the thermal donor media;

means for identifying an individual portion of the transfer panel of the donor media with each image; and means for positioning each individual portion of the transfer panel with respect to a receiving media to effect a donor transfer of the image to the receiving media.

* * * * *